US006183285B1

(12) United States Patent
Szu

(10) Patent No.: US 6,183,285 B1
(45) Date of Patent: Feb. 6, 2001

(54) RETENTION MECHANISM

(75) Inventor: Ming-Lun Szu, Taipei (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/427,146

(22) Filed: Oct. 25, 1999

(30) Foreign Application Priority Data

Dec. 28, 1998 (TW) ..... 87221651

(51) Int. Cl.[7] ..... H01R 13/73
(52) U.S. Cl. ..... 439/327; 439/567; 439/573
(58) Field of Search ..... 439/327, 328, 439/573, 567, 571, 572, 377, 557

(56) References Cited

U.S. PATENT DOCUMENTS 4,363,530 * 12/1982 Verhoeven ..... 439/557
5,254,016 * 10/1993 Ganthier ..... 439/567
5,993,252 * 11/1999 Laurx ..... 439/573
6,000,960 * 12/1999 Wang et al. ..... 439/327
6,027,372 * 2/2000 Lai et al. ..... 439/573
6,030,251 * 2/2000 STark et al. ..... 439/573
6,031,725 * 2/2000 Scholder et al. ..... 439/573

* cited by examiner

*Primary Examiner*—Gary F. Paumen
(74) *Attorney, Agent, or Firm*—Wei Te Chung

(57) ABSTRACT

A retention mechanism includes a frame and a pair of fixing devices. The fixing device includes a pair of locking screws and an engaging member. The locking screw forms a circular head and a conical threaded post. The engaging member includes a base pad and a pair of locking silos formed on lateral sides of the base pad. The locking silos are received in corresponding holes of a circuit board and the receiving holes of the retention mechanism, and the locking screw is inserted into a hole of the locking silo. Thus, the locking silo is expanded by the conical threaded post and an engaging force is provided between the locking silo and the circuit board. Therefore the retention mechanism is securely fixed to the circuit board.

2 Claims, 4 Drawing Sheets

RETENTION MECHANISM

BACKGROUND OF THE INVENTION

The present invention relates to a retention mechanism, and particularly to a retention mechanism having a simple fixing structure for securely fixing the retention mechanism to a circuit board.

Conventionally, a CPU package connects with a circuit board through a connector, wherein the CPU package and the connector are horizontally oriented on the circuit board. Such a configuration has a disadvantage that a large amount of the circuit board space is occupied by the connector and the CPU package. Recently, a new type of connector which vertically connects a CPU package to a circuit board was developed. This type of connector requires a vertical retention mechanism for securing the CPU package to the connector. Furthermore, a fixing device is needed for mounting the retention mechanism on the circuit board.

Referring to FIG. 1, a conventional retention mechanism comprises a pair of leading arms 52 attached at lateral sides of a base frame 51. The base frame 51 forms a pair of bases 53 at lateral sides thereof, each base 53 forming a pair of receiving holes 531 for receiving corresponding engaging members 61 therein. A plurality of screws 62 attaches a pair of locking pads 63 to a circuit board 7. The screws 62 extend through holes 631 in the pads 63, and then locking holes 71 formed in the circuit board 7 to engage with corresponding engaging members 61 for fixing the base frame 51 to the circuit board 7.

However, the assembly process is complicated, and is not well suited for mass production. Furthermore, the screws 62 are made of metal which requires expensive machining.

Thus, there is a need for an improved fixing device with fewer, more reliable locking elements for simplifying the manufacturing process.

BRIEF SUMMARY OF THE INVENTION

A main object of the present invention is to provide a retention mechanism having a fixing device with improved locking elements for facilitating the assembly process.

To fulfill the above-mentioned object, a fixing device according to a preferred embodiment of the present invention comprises a pair of locking screws and an engaging member. Each locking screw comprises a circular head and a post. The engaging member comprises a base pad and a pair of locking silos formed on lateral sides of the base pad.

The locking silo extends through a hole of a circuit board and a receiving hole of a retention mechanism, and the locking screw is inserted into a hole of the locking silo. Thus, the locking silo is expanded by the post and an engaging force is provided between the locking silo and the circuit board. Therefore the retention mechanism is securely fixed to the circuit board. For facilitating insertion of the locking screw, the end of the locking screw is formed with a subulate shape and the cap forms a central slot.

Other objects, advantages and novel features of the invention will become more apparent from the following detailed description when taken in conjunction with the accompanying drawings.

DETAILED DESCRIPTION OF THE INVENTION

Figure 1:
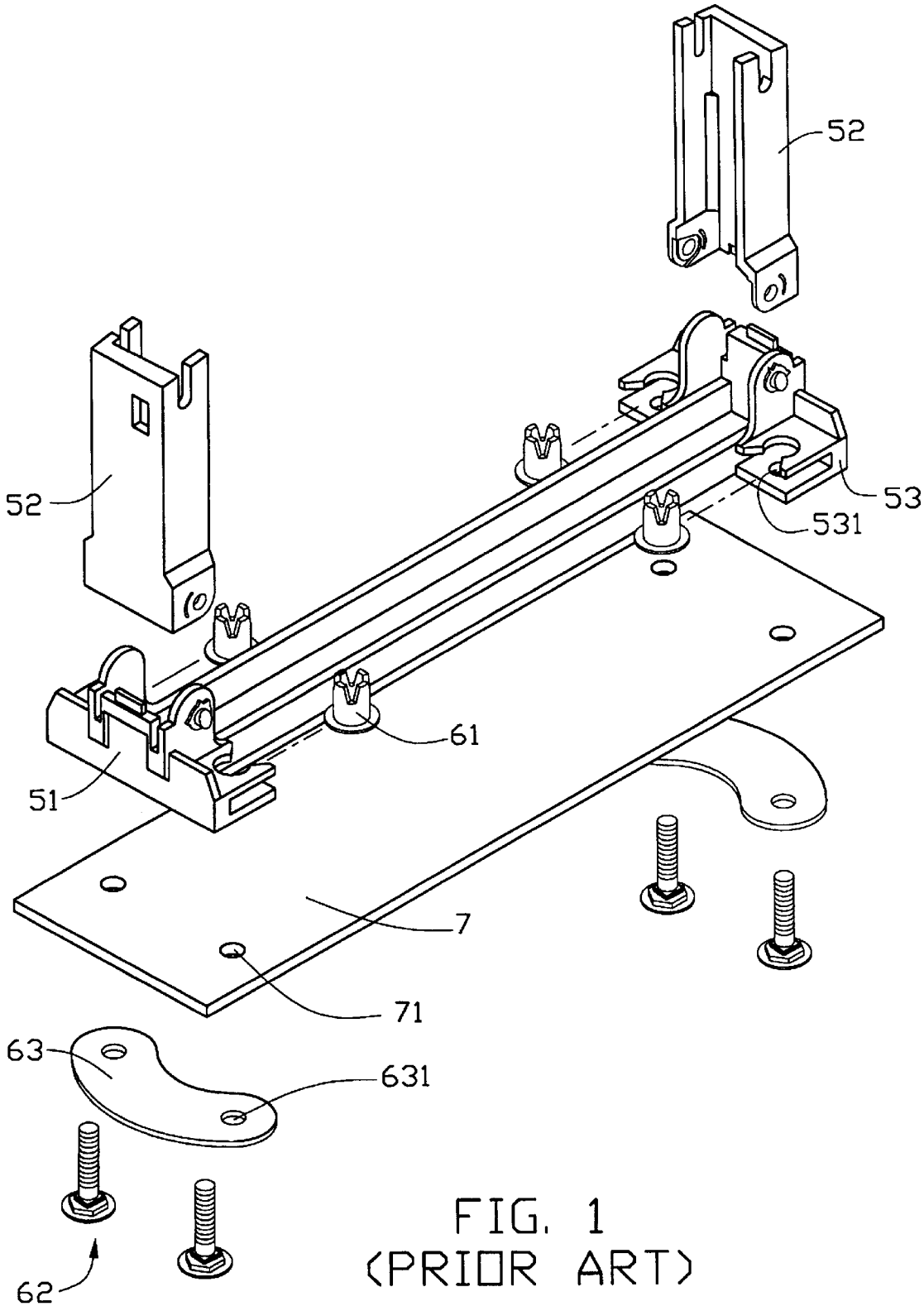
FIG. 1 (PRIOR ART)
FIG. 1 is an exploded view of a conventional retention mechanism and a circuit board.
Figure 2:
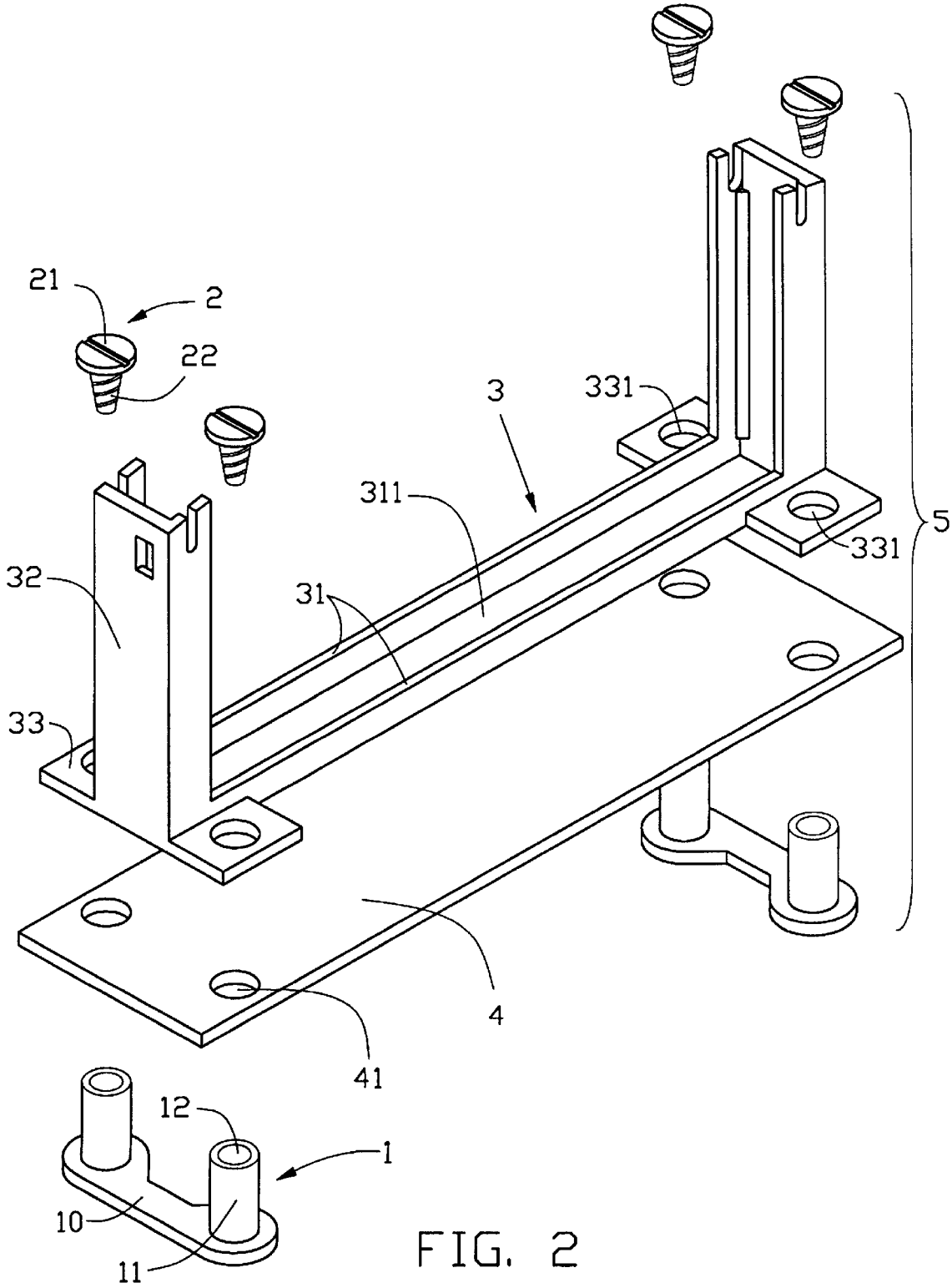
FIG. 2 is an exploded view of a retention mechanism in accordance with the present invention and a circuit board.
Figure 3:
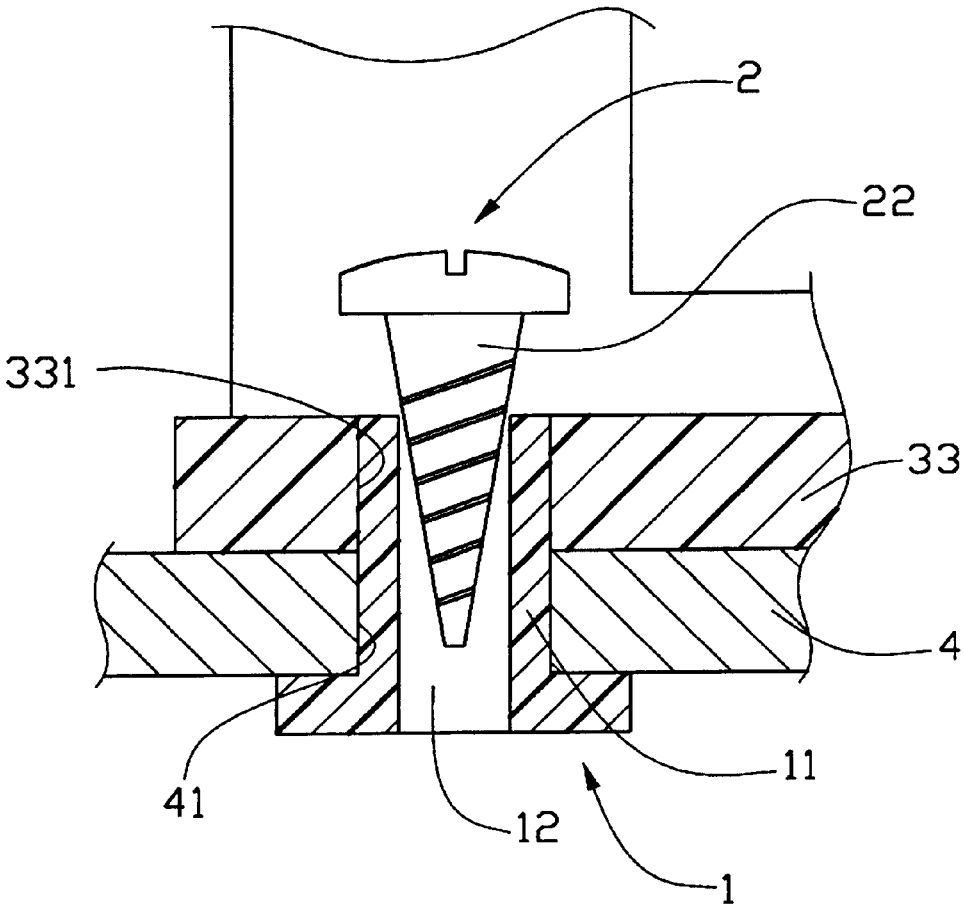
FIG. 3 is a partial, cross-sectional view of a fixing device locking the retention mechanism to the circuit board.

Referring to FIGS. 2 and 3, a retention mechanism 5 comprises a frame 3 and a pair of retaining arms 32 vertically formed at lateral sides of the frame 3. The frame 3 has a body 31 defining a central channel 311 for receiving a connector (not shown) therein. A CPU package (not shown) will be inserted into the mechanism 5 to electrically connect with a circuit board 4 through the connector, which is well known by those skilled in the art. A pair of bases 33 is formed at lateral sides of the frame 3, each base forming a pair of receiving holes 331. A pair of fixing devices each comprises a pair of locking screws 2 and an engaging member 1. Each locking screw 2 comprises a circular head 21 defining a slot (not labeled) for facilitating a manipulation of the screw 2 by a flat screwdriver (not shown) and a conical threaded post 22 extending downwardly from the head 21. The engaging member 1 comprises a base pad 10 and a pair of locking silos 11 upwardly projecting from lateral sides of the base pad 10. Each silo 11 defines a central hole 12 therein.

During assembly, the locking silos 11 are extended through corresponding holes 41 in the circuit board 4 and then the receiving holes 331. Thereafter, the locking screws 2 are driven into the corresponding holes 12 of the locking silos 11. Thus, each locking silo 11 is expanded by the post 22 to tightly engage with the bases 33 and the circuit board 4. Therefore the retention mechanism 5 is securely fixed to the circuit board 4.

Figure 4:
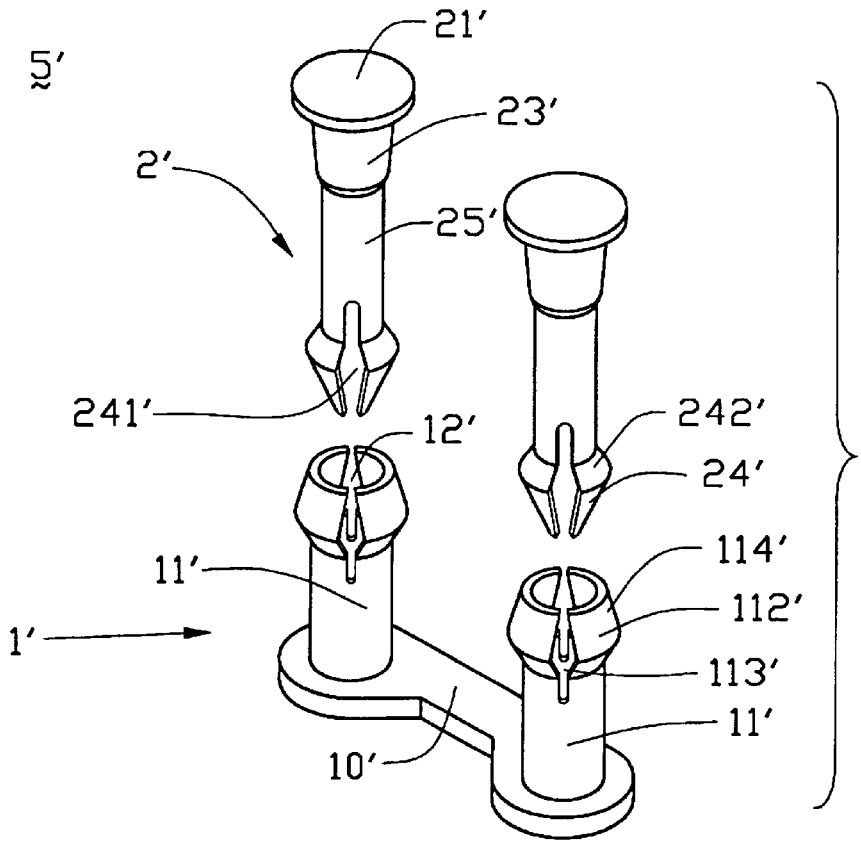
FIG. 4 is a perspective view of an alternative fixing device.
Figure 5:
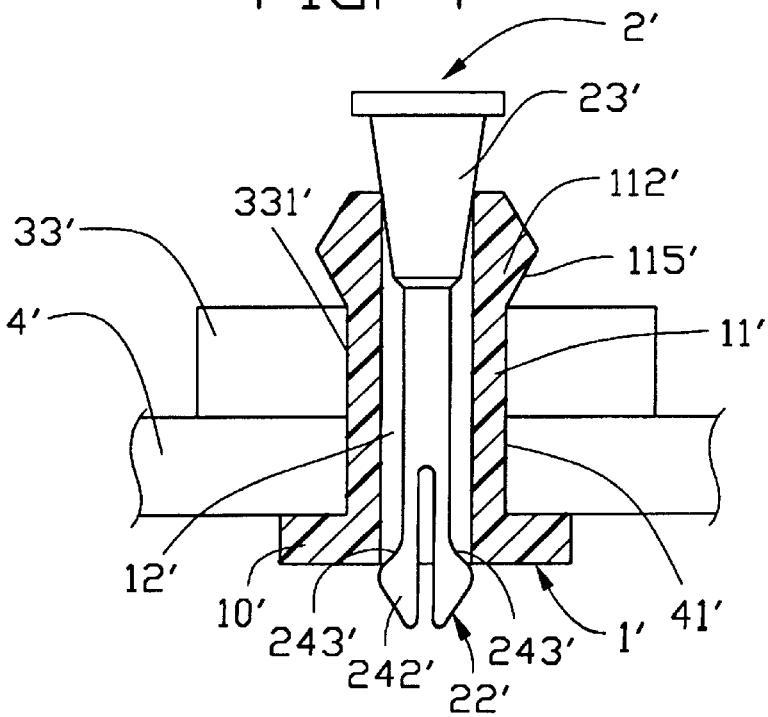
FIG. 5 is a cross-sectional view of the alternative fixing device assembled with the circuit board.

FIGS. 4 and 5 illustrate another embodiment of the fixing device. The fixing device comprises an engaging member 1' and a pair of locking posts 2'. Each locking post 2' comprises a cap 21' at a top free end. A truncated cone 23' forms the transition between the cap 21' and a cylindrical shank 25', and a tip portion 24' is formed at the bottom free end of the locking post 2'. A central slot 241' is formed in the tip portion 24' for enhancing the resilience of the tip portion 24'. The slot 241' divides the tip portion 24' into two symmetrical halves 242' each having a slanting, up-facing face 243'. The engaging member 1' comprises a base pad 10' and a pair of locking silos 11' projecting upwardly from lateral sides of the base pad 10'. Each of the locking silos 11' forms a head 112' at a top portion thereof. A hole 12' is defined in each silo 11'. A slot 113' is defined through the head 112' to divide the head 112' into two symmetrical halves 114' to increase the resilience of the head 112'. Each half 114' has a slanting, down-facing face 115'.

During assembly the locking silos 11' are extended through corresponding holes 41' in a circuit board 4' and then receiving holes 331' of a base 33' of a retention mechanism. The engaging member 1' is fixed in position by an engagement between the base 33' and the slanting, down-facing faces 115' of the head 112'. The locking posts 2' are thereafter inserted into the holes 12' to reach a position as shown in FIG. 5, wherein the tip portions 24' extend through the holes 12' and the slanting, up-facing faces 243' tightly engage with a bottom face (not labeled) of the base pad 10'. Each head 112' is expanded outwardly by the corresponding truncated cone 23' to further tightly engage with the base 33'. Thus, the retention mechanism is securely mounted on the circuit board 4'.

Thus, the fixing device is simplified compared to the conventional design having only two elements, and the assembly process is more effective.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A retention mechanism for securing a CPU package on a circuit board comprising:

a frame having a body defining a central channel for receiving a connector therein;

a pair of retaining arms vertically formed at lateral sides of the frame for retaining a CPU package therein;

a pair of bases formed at lateral sides of the frame, each base forming a pair of receiving holes; and a fixing device comprising:

an engaging member having a base pad and a pair of locking silos formed on lateral sides of the base pad, each of the locking silos forming a hole, the locking silos being received in the corresponding receiving holes of the retention mechanism and corresponding holes of the circuit board; and a pair of locking screws each comprising a circular head and a post for insertion into the locking silo of the engaging member to provide an engaging force between the retention mechanism and the circuit board.

2. A retention assembly comprising:

a base defining at least one receiving holes;

a printed circuit board tightly positioned below the base and defining therein a locking holes in alignment with said receiving hole of the base;

an engaging member defining a base pad and a locking silos extending therefrom with an internal hole therein, said locking silos defining an expanded head at a distal free end thereof; and a locking post defining a cap and a deflectable tip portion opposite to each other; wherein the locking silos extends through the locking holes of the printed circuit board and the receiving hole of the base successively with the base pad abutting against said printed circuit board and the expanded heads abutting against the base, and wherein the locking posts extends through the internal holes of the locking silos with the deflectable tip portions latchably engaged with the base pad around said internal holes for preventing backward movement of the locking posts within the internal holes, and with a portions thereof adjacent to the caps forcibly expanding outwardly the heads of the engaging members to latchably engage the base around the receiving hole for preventing backward movement of the engaging members within the receiving holes.

* * * * *